US009723901B1

(12) United States Patent
Ober et al.

(10) Patent No.: US 9,723,901 B1
(45) Date of Patent: Aug. 8, 2017

(54) SELF-RIGHTING CANE

(71) Applicant: PT Solutions Today, LLC, Dover, DE (US)

(72) Inventors: Jake Ober, Las Vegas, NV (US); Thomas John Travers, Davie, FL (US)

(73) Assignee: PT Solutions Today, LLC, Dover, DE (US)

( * ) Notice: Subject to any disclaimer, the term of this patent is extended or adjusted under 35 U.S.C. 154(b) by 0 days.

(21) Appl. No.: 15/147,858

(22) Filed: May 5, 2016

Related U.S. Application Data

(60) Provisional application No. 62/307,107, filed on Mar. 11, 2016.

(51) Int. Cl.
*A45B 9/04* (2006.01)
*A61H 3/02* (2006.01)

(52) U.S. Cl.
CPC ..... *A45B 9/04* (2013.01); *A61H 3/0244* (2013.01)

(58) Field of Classification Search
CPC ..... A61H 3/0244; A45B 9/04
See application file for complete search history.

(56) References Cited

U.S. PATENT DOCUMENTS

| | | | | | |
|---|---|---|---|---|---|
| 1,465,642 | A * | 8/1923 | Keene | A47K 1/09 | 206/362.2 |
| 3,289,685 | A * | 12/1966 | McCall Parker | A61H 3/0244 | 135/65 |
| 5,301,703 | A * | 4/1994 | Kahn | A45B 9/04 | 135/77 |
| 5,392,800 | A | 2/1995 | Sergi | | |
| 5,392,801 | A * | 2/1995 | Hannoosh | A45B 3/00 | 135/65 |
| 5,485,862 | A * | 1/1996 | Kahn | A61H 3/068 | 135/77 |
| 6,527,001 | B1 * | 3/2003 | Saldan | A45B 9/04 | 135/65 |
| 6,604,489 | B2 * | 8/2003 | Wilkes | A01K 15/02 | 119/705 |
| 6,668,846 | B2 | 12/2003 | Meador | | |
| 6,708,705 | B2 | 3/2004 | Nasco, Sr. | | |
| D632,476 | S * | 2/2011 | Owens | D3/17 | |
| 8,418,705 | B2 | 4/2013 | Ota et al. | | |
| 8,627,839 | B1 | 1/2014 | Martinez | | |
| 8,919,362 | B1 | 12/2014 | Mortenson | | |
| 2013/0199587 | A1 * | 8/2013 | Reydel | A45B 9/04 | 135/77 |

FOREIGN PATENT DOCUMENTS

| | | | | |
|---|---|---|---|---|
| AU | 2012101787 | A4 * | 1/2013 | |
| CN | 1057902 | C | 11/2000 | |
| DE | 3501050 | A1 * | 7/1986 | A45B 9/04 |
| FR | 2668690 | A1 * | 5/1992 | A45B 9/04 |
| FR | 2844429 | A1 * | 3/2004 | A45B 9/04 |

* cited by examiner

*Primary Examiner* — David R Dunn
*Assistant Examiner* — Danielle Jackson
(74) *Attorney, Agent, or Firm* — Weide & Miller, Ltd.

(57) ABSTRACT

A self-righting cane is provided that includes a handle portion having a grip and a collar. A shaft extends from the handle portion and is joined to the handle portion at the collar. A base supporting portion includes a weight disposed within the base supporting portion. The weight has an aperture such that the shaft connecting to the base supporting portion through the aperture. The weight disposed within the base supporting portion self-rights the cane and prevents the cane from falling over.

17 Claims, 6 Drawing Sheets

SELF-RIGHTING CANE

BACKGROUND

The disclosed embodiments relate to physical therapy devices. More specifically, the disclosed embodiments are related to canes or devices to aid in walking.

Many people have occasion during their lives where personal mobility may become difficult. For example, injury, disease, accidents, old age, or other situations may arise where a person finds it more difficult to walk around unassisted. To help in such situations, canes and crutches are used to help a person retain his or her mobility.

As a person uses a cane or crutches to move about, he or she often needs to temporarily store the cane or crutches to complete a separate task, to sit down, or the like. Typically, the person will attempt to store the cane or crutches in an upright position. For example, the person may lean the cane or crutches against a wall or furniture. Sometimes, despite the person's best efforts, the cane or crutches fall over. For a person with limited mobility, it can be very difficult to retrieve the cane or crutches.

For example, it has been observed that almost half of all patients having gone to an outpatient musculoskeletal clinic do so because of lumbar spine pain, a condition in the spinal column of L1-L5. Indeed, the prevalence of low back pain is increasing. For such people with limited mobility, it may be very difficult and/or painful to retrieve canes or crutches that have fallen over.

When a cane is not easily accessible, for example, because it has fallen over or is located against a wall or furniture away from the user, the chance for falling increases. According to a WHO global risk fall report, approximately 28-35% of people aged of 65 and over fall each year, increasing to 32-42% for those over 70 years of age.

Further, when the elderly bend over and naturally flex the lumbar spine, they put themselves in a position where they are prone for a herniation, or to increase the pain of an already increasing herniation, or to increase the pain from foraminal stenosis. Thus, situations where canes or crutches end up of the floor should be avoided.

SUMMARY

Given the above, there is a need for a cane or crutches that may be easily accessible even when temporarily stored during a period of non-use. Accordingly, in one embodiment, a self-righting cane is provided that includes a handle portion having a grip and a collar. A shaft extends from the handle portion and is joined to the handle portion at the collar. A base supporting portion includes a weight disposed within the base supporting portion. The weight has an aperture such that the shaft connecting to the base supporting portion through the aperture. The weight disposed within the base supporting portion self-rights the cane and prevents the cane from falling over.

In further embodiments, the base supporting portion further may comprise a ferrule collar. The ferrule collar is disposed so as to cover the weight and surround the shaft. The ferrule collar may be hollow. It may also be configured with a rounded conical shape.

In some embodiments, a width of the base supporting portion is at least twice that of a width of the shaft in order to provide added stability. In other embodiments, the width may be at least three times the width of the shaft. The base supporting portion may be formed in a circular shape. The base supporting portion may have a diameter from two to six inches. The weight within the base supporting portion may be disc shaped. The base supporting portion may also comprise an annular channel surrounding the weight. In some instances, the length of the shaft is extendable.

According to another embodiment, a base supporting portion for self-righting a cane, crutch, or staff is provided. The base supporting portion includes a bottom surface, an internal space configured with a weight disposed therein, and a ferrule collar for connecting to the cane, crutch, or staff. The ferrule collar may be disposed so as to cover the weight and surround a shaft of the cane, crutch, or staff. The ferrule collar is hollow and may have a rounded conical shape.

A width of the base supporting portion may be at least twice that of a width of a shaft of the cane, crutch, or staff. In some instances, the base supporting portion comprises a circular shape. A diameter of the base supporting portion may be between two and six inches. The weight may disc shaped to fit within the circular base supporting portion. The base supporting portion may also comprise an annular channel surrounding the weight. An external layer may be disposed on the bottom surface of the base supporting portion so as to cover and protect the bottom surface.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF EMBODIMENTS

Figure 1:
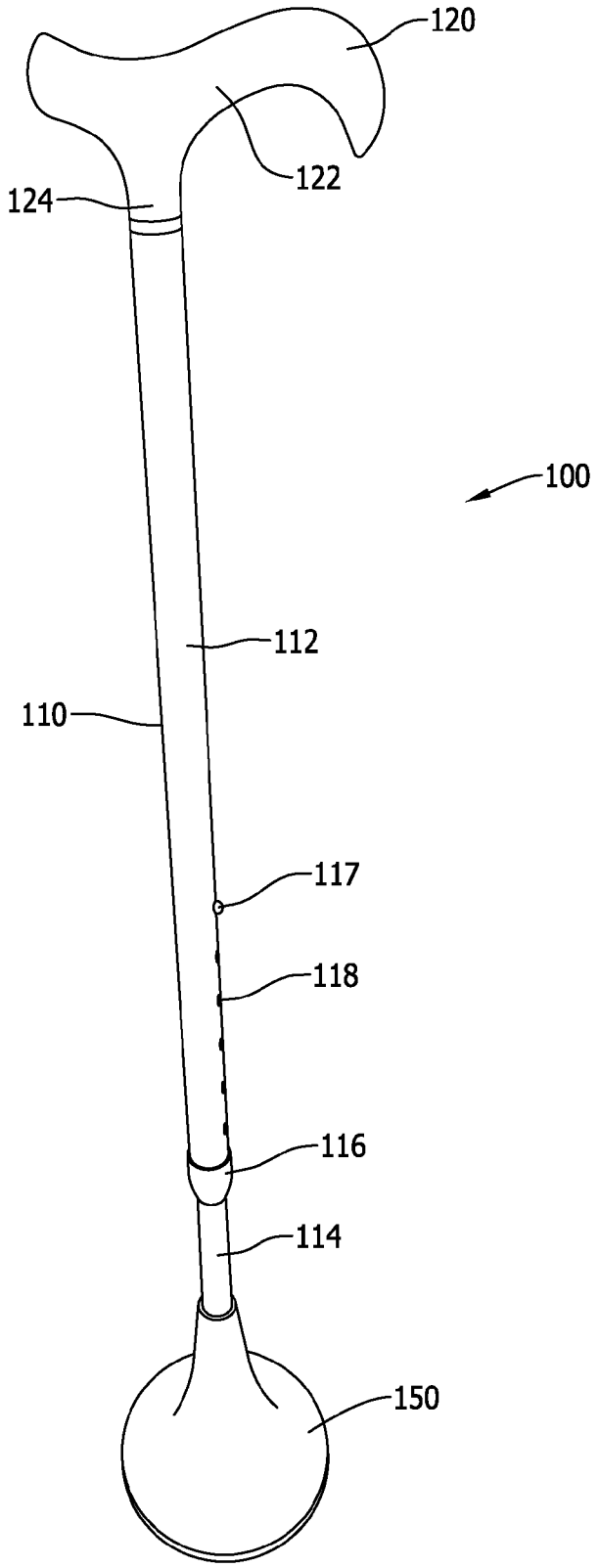
FIG. 1 is a perspective view of a self-righting cane, according to one exemplary embodiment.

FIG. 1 is a perspective view of a self-righting cane, according to one exemplary embodiment. In FIG. 1, there is a cane 100 having a shaft 110, handle portion 120, and a base 150. The cane 100 is merely exemplary, and any number of other designs or styles of canes may be used. Further, other walking aids are considered to be within the scope of the disclosure, such as crutches, staffs, or the like.

The handle portion 120 includes a grip 122 which a user may grasp to hold onto the cane 100 while walking. A collar 124 is also provided at a lower end of the handle portion 120. The collar 124 is configured to attach to the shaft 110. The handle portion may be manufactured from any suitable material such as various plastics, woods, metals, or other natural or synthetic materials. The handle 120 may include an outer coating material to facilitate grip, such as a rubber material in some embodiments. The handle 120 may be constructed to be removable from the shaft 110, or may be permanently affixed thereto.

The shaft 110 comprises an upper shaft 112 and a lower shaft 114 so as to be extendable. In some embodiments, however, the shaft 110 may be a fixed length. The upper shaft 112 may comprise a number of apertures 118. The apertures 118 are configured to receive a biased pin 117 of the lower shaft to lock the lower shaft 114 into one a plurality of positions relative to the upper shaft 112. In this manner, the height of the cane 100 may be adjusted. This, of course, is just one example of a height adjustment, and any other height adjustment technique may be utilized.

The upper shaft 112 may further comprise a lower collar 116 to reinforce the connection between the upper shaft 112 and the lower shaft 114. In some embodiments, the collar 116 may be a locking collar to lock the upper shaft 112 relative to the lower shaft 114 to adjust the height of the shaft 110. The shaft 110 may be constructed of any suitable material including metals such as aluminum, plastics, carbon-fiber, or other natural or synthetic materials.

Figure 2:
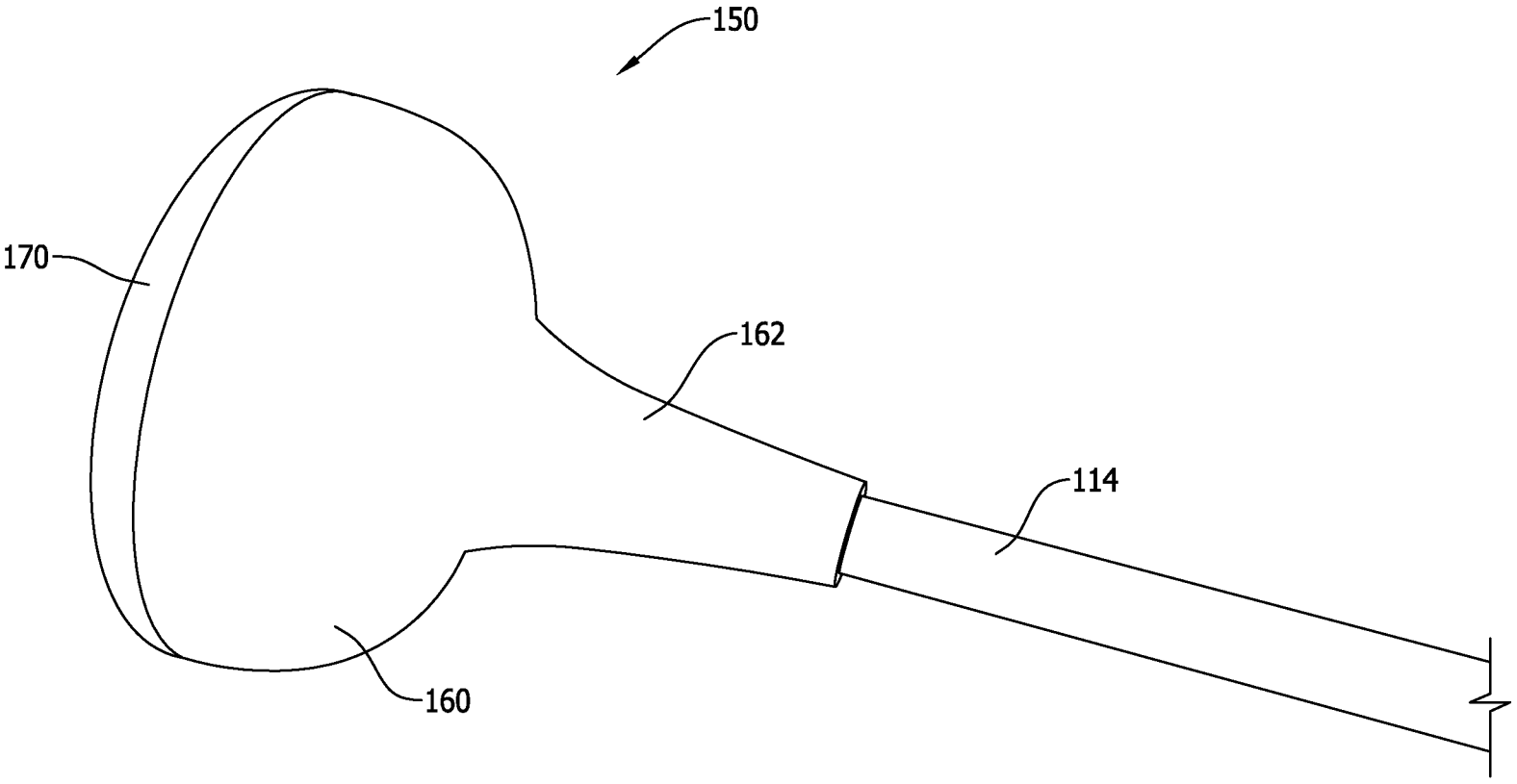
FIG. 2 is a perspective view of a base of a self-righting cane, according to one exemplary embodiment.

FIG. 2 is a perspective view of a base of a self-righting cane, according to one exemplary embodiment. The base 150 comprises a ferrule collar 160 and a base support 170. The ferrule collar 160 includes a ferrule 162 that attaches to and reinforces the lower shaft 114.

Figure 3:
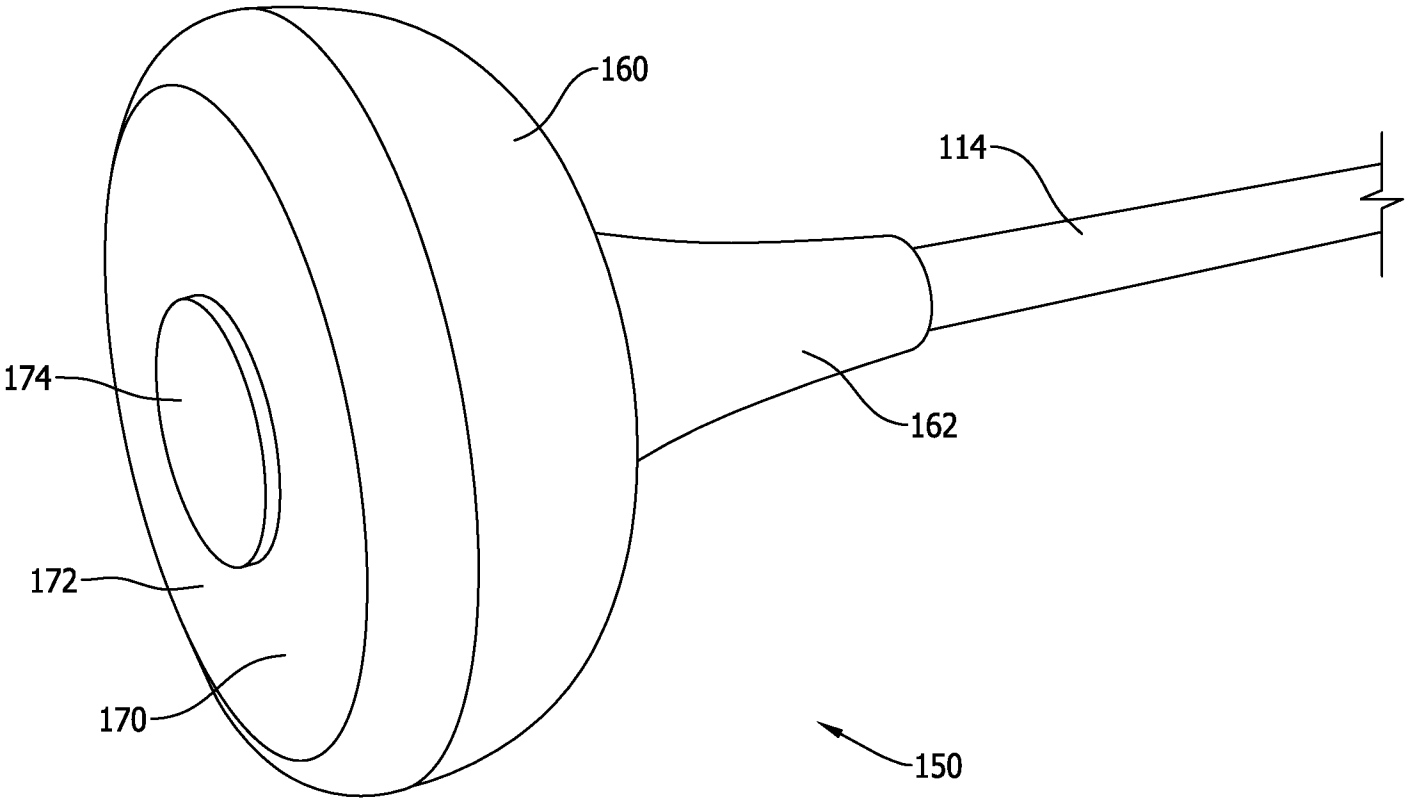
FIG. 3 is another perspective view of a base of a self-righting cane, according to one exemplary embodiment.

FIG. 3 is another perspective view of a base of a self-righting cane, according to one exemplary embodiment. As shown in FIG. 3, the base support 170 comprises a bottom surface 172 that comes into contact with the ground or other surface. The bottom surface 172 may further comprise an outer layer 174. The outer layer 174 may be overlaid on the bottom surface 172 to provide the surface 172 protection from wear, to reduce noise during use, and/or to dampen the impact when the surface 172 comes into contact with the ground.

Figure 4:
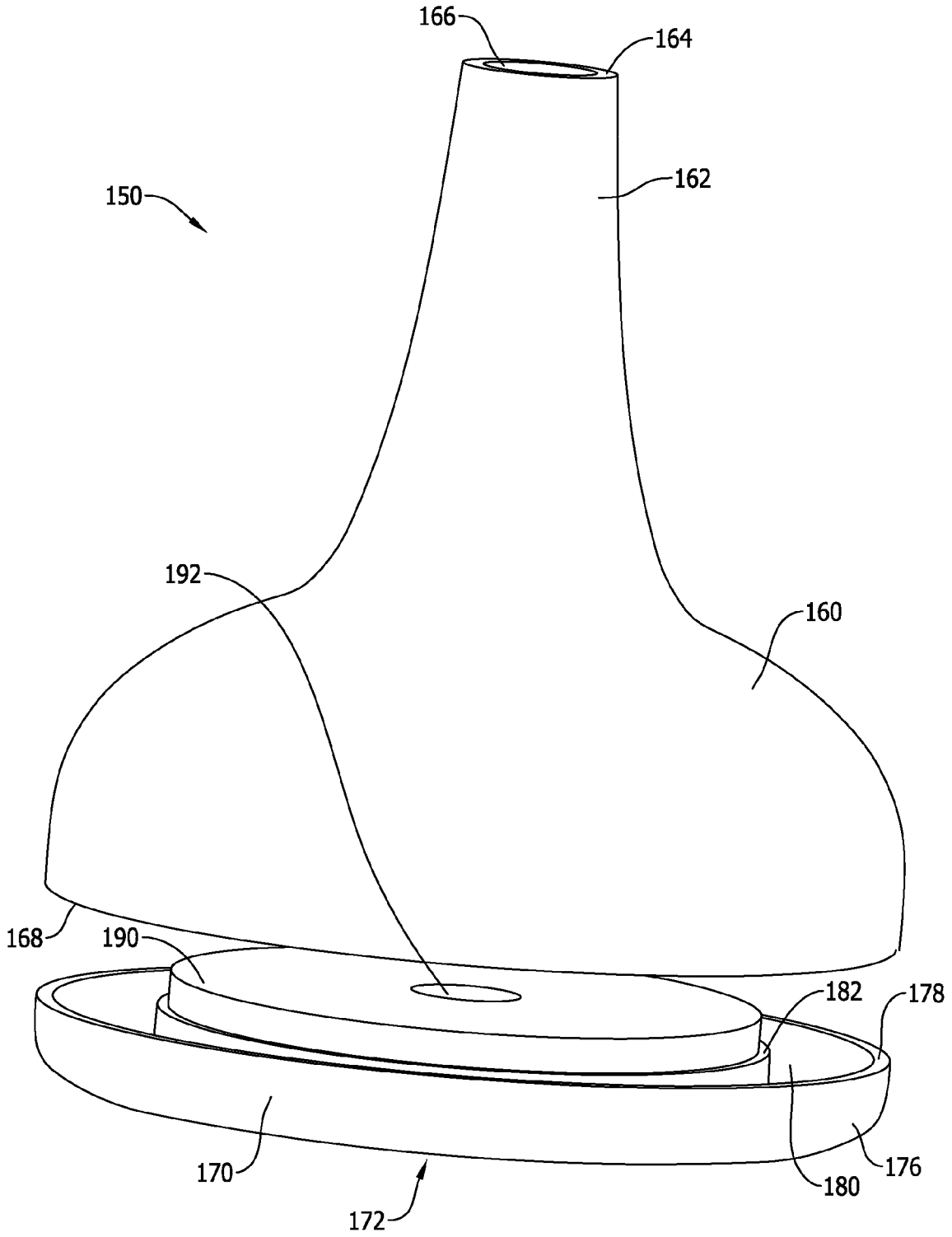
FIG. 4 is an exploded view of a base of a self-righting cane, according to one exemplary embodiment.

FIG. 4 is an exploded view of a base of a self-righting cane, according to one exemplary embodiment. As shown in FIG. 4, ferrule 162 of the collar 160 comprises a top surface 164. The top surface 164 includes an aperture 166 through which the shaft 110 extends. The collar 160 further comprises a lower surface 168.

Figure 5:
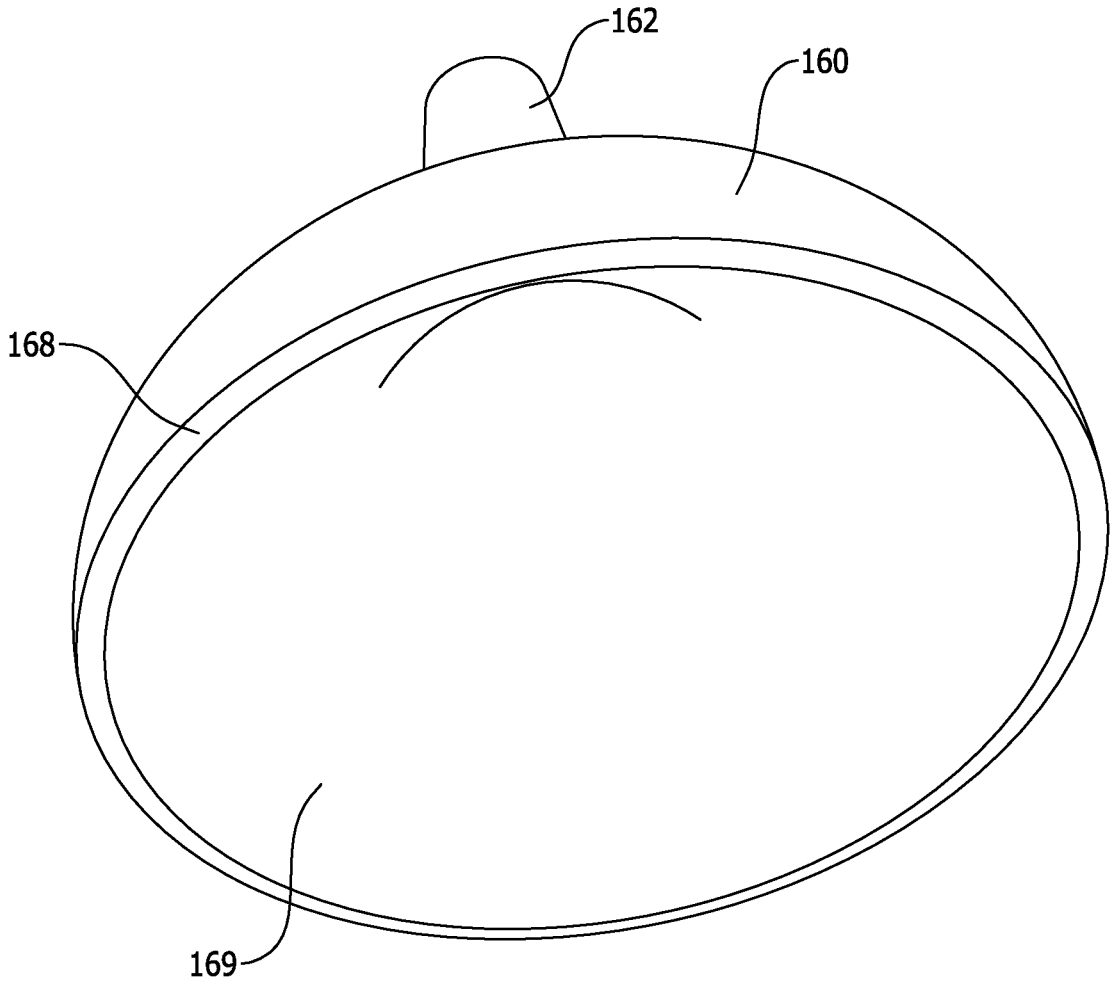
FIG. 5 is a perspective view of a ferrule collar, according to one exemplary embodiment.

FIG. 5 is a perspective view of a ferrule collar, according to one exemplary embodiment. The collar 160 may also comprise a hollow interior 169. The collar 160 in this embodiment is formed in a rounded cone-like shape. However, the collar 160 may be formed in any suitable shape according to the design preferences of the user. The collar 160 may be manufactured from any suitable light weight material including metals such as aluminum, plastics, carbon-fiber, or other natural or synthetic materials.

Returning to FIG. 4, the base support 170 comprises a bottom surface 172 with a rounded edge 176. The rounded edge 176 facilitates a range of motion for the cane 100 during use and facilitates the self-righting characteristics as will be described in more detail below. The base support 170 further comprises an upper lip 178 that comes into contact with the lower surface 168 of the collar 160. A second lip (annular flange) 182 is provided on a top side of the base support 170 and defines along with the lip 178 an annular hollow space or annular channel 180 within the base 170 and on the top side of the base 170.

A weight 190 is disposed within the second lip 182. The weight 190 thus rests on the bottom of the base support 170. The weight 190 in this embodiment is formed in a disc shape. However, other shapes may also be utilized. The weight 190 comprises an aperture 192 into which the shaft 110 may be inserted.

Figure 6:
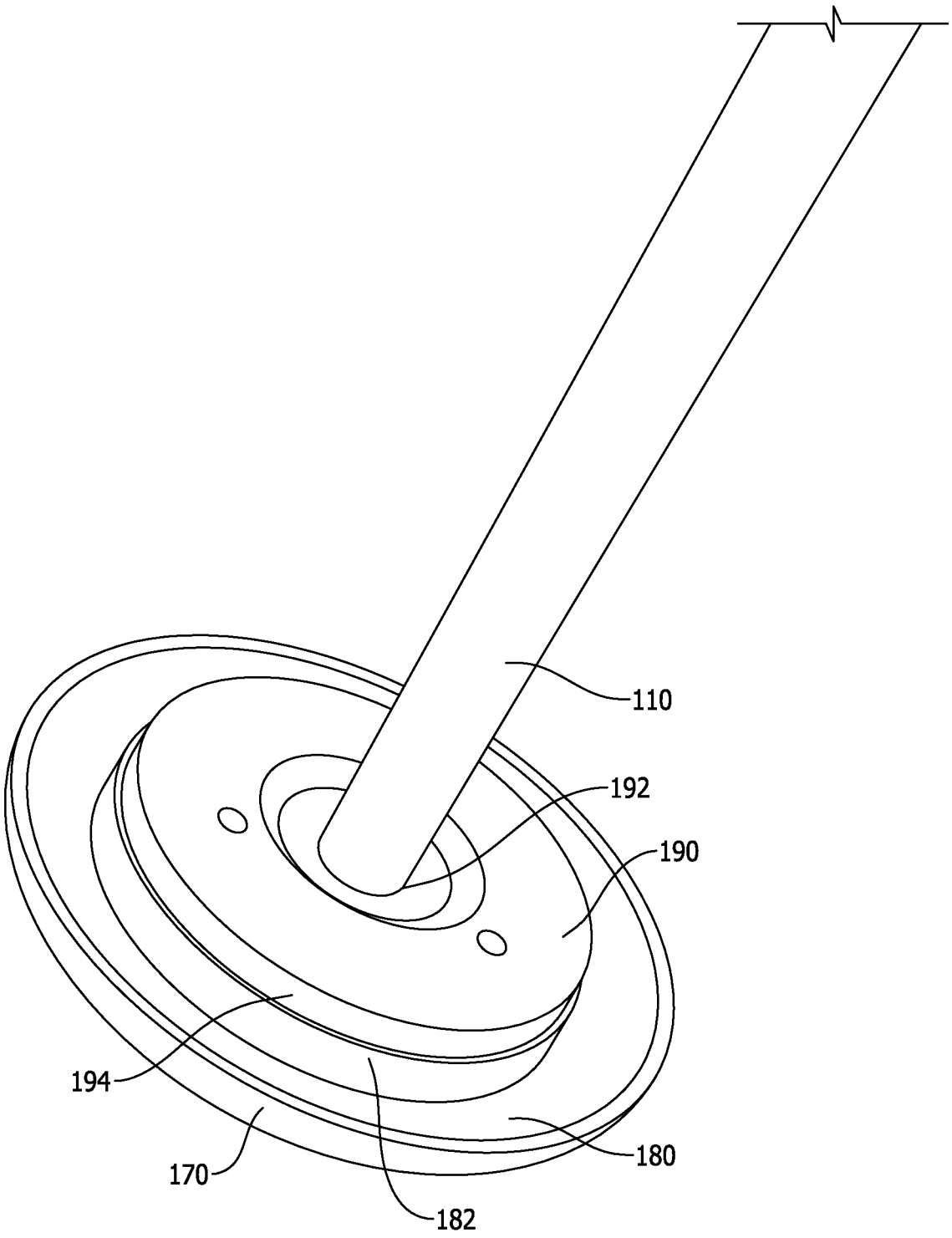
FIG. 6 is a perspective view of a base support for a self-righting cane, according to one exemplary embodiment.

FIG. 6 is a perspective view of a base support for a self-righting cane, according to one exemplary embodiment. As shown in FIG. 6, the shaft 110 may be connected to the base 170 by extending through the aperture 192 of the weight 190. The base portion 170 and weight 190 are formed in a circular shape having a diameter substantially larger than the shaft 110. For example, the diameter of the base portion 170 and weight 190 may be more than twice the diameter of the shaft in some embodiments, or more than three times the diameter of the shaft. With the support 170 having a relatively large diameter and the weight 190 being disposed at the bottom of the cane 100 within the support 170, the cane 100 takes on self-righting characteristics.

Typical canes or crutches have a fairly even weight distribution along the length of the cane or crutch. Because of this, it is difficult to balance the cane or crutch because when the cane or crutch is slightly off-center, the torque produced by the weight of the cane is sufficient to cause the cane to tip and fall. With the base support 170 and weight 190, the shape and the weight distribution of the base support 170 counteract against a torque caused by the handle 120 being off-center. This tends to cause the cane to self-right in a balanced, standing position even when the cane is placed onto a surface without the shaft 10 being placed in an exactly vertical orientation.

The diameter of the support 170 and the weight of the weight 190 may vary based on the amount of self-righting desired. For example, in some embodiments the diameter of the support may range from two inches to six inches. In other embodiments, the diameter of the support may range from three inches to five inches. The weight may be configured from eight ounces to three pounds in some embodiments. In other embodiments, the weight may be configured from one pound to two pounds.

The configuration of the base 170 and weight 190 affect a maximum angle of the shaft 110 from the vertical at which the cane with self-right. In one embodiment, the base 170 and weight 190 are configured such that the cane 100 self-rights when the shaft is as far as 22 degrees or less from the vertical. In other embodiments, the cane 100 self-rights when the shaft is 30 degrees or less from the vertical. In still further embodiments, the cane 100 self-rights when the shaft is 15 degrees or less from the vertical.

Further modifications and additions may be made to the cane 100 or crutches with the self-righting features as described herein. For example, the handle portion of the cane may facilitate any number of add-on devices such as pill cases, insulin pack, blood pressure cuffs, and the like. In some embodiments, the cane may comprise a speaker with a battery as a power source which can be remotely actuated. The speaker may help a person find the cane, such as a person who is visually impaired.

The cane including the handle, shaft, and base support may be configured in any variety of styles and ornamentation to appeal to various user preferences. For example, pictures of favorite sports teams or memories may be included on the cane handle, lightening up the day of a person who much use the cane, such as one who has experienced and accident or who may be elderly.

The self-righting cane may provide a number of advantages. First, the cane may simply be set on the floor and will remain standing until retrieved. This allows the cane to be temporarily stored at any location such that the user can briefly leave the cane while attending to another task. This also prevents the risk of falls, pain associated with bending over, and other similar problems posed by canes incapable of self-righting.

Because the cane is self-righting and easily retrievable by the user, it is possible that a user undergoing therapy to regain mobility may advance to using the cane sooner than other canes. Advancing to single point ambulation is an important milestone for patients progressing to the point of becoming independent from the help of an ambulation aid. Further, any slight increase in the weight of the self-righting cane as compared with other canes (though not substantial enough to affect normal ambulation in any way) may aid in elderly patients recovering from muscular atrophy, again helping the patient to become more independent. Studies also show that the more confident a patient is about their ability to prevent themselves from falling, the less they will actually fall, another advantage of the embodiments.

The ability of the cane to self-right may also aid in the treatment of neurological symptoms. Neurological symptoms caused from musculoskeletal conditions are extremely common in the elderly. Neurological pathologies caused by traumatic brain injuries, spinal cord conditions, strokes, genetic conditions, vestibular pathologies, or any pain/disorder stemming from the brain and spinal cord may be common in any age. The ability for this cane according to the embodiments herein to self-right may aid in the growth of vestibular rehabilitation. This is because a patient may often and naturally track the movement of the cane with the eyes. Such eye tracking may be beneficial in a patient with a condition such as nystagmus.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A self-righting cane comprising:

a handle portion including a grip and a collar, the handle portion defining a top side of the self-righting cane;

a shaft extending from the handle portion and joined to the handle portion at the collar; and a base supporting portion defining a bottom side of the self-righting cane, the base supporting portion comprising a weight disposed within the base supporting portion, the weight comprising an aperture, and the shaft connecting to the base supporting portion and extending through the aperture, and a ferrule collar covering the weight and surrounding the shaft, the ferrule collar being formed with a width that narrows from the bottom side towards the top side, wherein the base supporting portion comprises a bottom surface, the surface having a rounded edge extending continuously upwards from the bottom surface to form a lip, the lip being in contact with a lower surface of the ferrule collar, the base supporting portion further comprising an annular flange extending upwards from a top side of the base supporting portion, the weight being disposed on the base supporting portion within the annular flange, and the lip and the annular flange defining an annular channel surrounding the weight on the top side of the base supporting portion.

2. The self-righting cane of claim 1, wherein the ferrule collar is hollow.

3. The self-righting cane of claim 1, wherein the ferrule collar has a rounded conical shape.

4. The self-righting cane of claim 1, wherein a width of the base supporting portion is at least twice that of a width of the shaft.

5. The self-righting cane of claim 1, wherein the base supporting portion comprises a circular shape.

6. The self-righting cane of claim 5, wherein a diameter of the base supporting portion is between two and six inches.

7. The self-righting cane of claim 5, wherein the weight is disc shaped.

8. The self-righting cane of claim 1, wherein a length of the shaft is extendable.

9. A base supporting portion for self-righting a cane, crutch, or staff, the base supporting portion comprising:

a bottom surface having an annular, rounded edge extending continuously upwards from the bottom surface to form a lip, an annular flange projecting upwards from a top side of the base supporting portion, the lip and the annular flange defining an annular channel surrounding the annular flange on the top side of the base supporting portion, a weight disposed on the top side of the base supporting portion and within a space defined by the annular flange, and a ferrule collar that connects to a shaft of the cane, crutch, or staff, the ferrule collar extending upwards from the lip of the bottom surface and having a width that narrows from the first lip towards the shaft.

10. The base supporting portion of claim 9, wherein the ferrule collar covers the weight, the ferrule collar surrounding the shaft of the cane, crutch, or staff.

11. The base supporting portion of claim 10, wherein the ferrule collar is hollow.

12. The base supporting portion of claim 10, wherein the ferrule collar has a rounded conical shape.

13. The base supporting portion of claim 9, wherein a width of the base supporting portion is at least twice that of a width of a shaft of the cane, crutch, or staff.

14. The base supporting portion of claim 9, wherein the base supporting portion comprises a circular shape.

15. The base supporting portion of claim 14, wherein a diameter of the base supporting portion is between two and six inches.

16. The base supporting portion of claim 14, wherein the weight is disc shaped.

17. The base supporting portion of claim 9, further comprising an external layer disposed on the bottom surface of the base supporting portion configured to cover and protect the bottom surface.

* * * * *